US012520886B2

(12) United States Patent
Beland et al.

(10) Patent No.: US 12,520,886 B2
(45) Date of Patent: Jan. 13, 2026

(54) FOAM-PLASTIC PROTECTOR

(71) Applicant: SPORT MASKA INC., Montreal (CA)

(72) Inventors: Jean-François Beland, Montréal (CA); Brian Steenbrink, Pointe-Claire (CA)

(73) Assignee: SPORT MASKA INC., St-Laurent (CA)

( * ) Notice: Subject to any disclaimer, the term of this patent is extended or adjusted under 35 U.S.C. 154(b) by 0 days.

(21) Appl. No.: 17/475,638

(22) Filed: Sep. 15, 2021

(65) Prior Publication Data

US 2022/0079257 A1 Mar. 17, 2022

Related U.S. Application Data

(60) Provisional application No. 63/078,594, filed on Sep. 15, 2020.

(51) Int. Cl.
*A41D 13/015* (2006.01)
*A41D 13/05* (2006.01)

(52) U.S. Cl.
CPC ..... *A41D 13/015* (2013.01); *A41D 13/0512* (2013.01); *A41D 13/0518* (2013.01); *A41D 13/0531* (2013.01)

(58) Field of Classification Search
CPC ..... A41D 13/0518; A41D 13/0531; A41D 13/0512; A41D 13/0575; A41D 13/0543; A63B 71/12; A63B 2071/1208; A63B 2071/1241; A63B 2071/1258
See application file for complete search history.

(56) References Cited

U.S. PATENT DOCUMENTS

| | | | | |
|---|---|---|---|---|
| 2,163,463 | A * | 6/1939 | Kennedy | A63B 71/12 2/465 |
| 6,093,468 | A | 7/2000 | Toms et al. | |
| 6,789,274 | B1 | 9/2004 | Karpati | |
| 8,161,569 | B2 | 4/2012 | Hudon et al. | |
| 8,533,871 | B2 | 9/2013 | Fiegener et al. | |
| 2008/0313793 | A1 * | 12/2008 | Skottheim | A41D 13/0531 2/463 |
| 2011/0167548 | A1 * | 7/2011 | Jourde | A41D 13/0518 2/463 |
| 2014/0373259 | A1 | 12/2014 | Bergeron | |
| 2017/0191614 | A1 * | 7/2017 | Swan | A41D 13/0518 |

* cited by examiner

*Primary Examiner* — Khoa D Huynh
*Assistant Examiner* — Giao QT Hoang
(74) *Attorney, Agent, or Firm* — NORTON ROSE FULBRIGHT CANADA

(57) ABSTRACT

A foam-plastic protector includes a foam insert having a front surface and a rear surface. A plastic sleeve is harder than the foam insert and has a base and an overlapping portion spaced from the base to define a gap. The foam insert is received against the base and inter-locked with the plastic sleeve. A covered portion of the foam insert is positioned within the gap and covered by the overlapping portion of the plastic sleeve. A remainder of the foam insert is exposed. A protective sport padding and a method of assembling same are also disclosed. The foam insert may be fixedly attached to the protective sport padding.

12 Claims, 8 Drawing Sheets

FOAM-PLASTIC PROTECTOR

CROSS-REFERENCE TO RELATED APPLICATIONS

This application claims priority to U.S. patent application No. 63/078,594 filed Sep. 15, 2020, the entire contents of which are incorporated by reference herein.

TECHNICAL FIELD

The application relates generally to sports equipment, and more particularly, to protective wear worn by players for sports requiring protection.

BACKGROUND

Protectors or guards are used in areas of protective sports equipment that are prone to receive hits, or to cover areas of the body more at risk of getting injured. Such protectors are often made of foam, and existing foam guards can be made of various types of foams, having more or less stiffness, density and mass. Protectors made of foam are efficient at dissipating the energy received during hard impacts. However, these foam protectors also tend to become softer over time, especially if they have been repeatedly impacted, thereby making them less efficient at absorbing impacts.

As a result, foam protectors may be combined with harder components that will dissipate the impact to a greater extent. As an example, foam can be combined with a plastic reinforcement.

SUMMARY

There is disclosed a foam insert having a front surface and a rear surface; and a plastic sleeve removably receiving the foam insert, the plastic sleeve being harder than the foam insert and having a base and an overlapping portion spaced from the base to define a gap, the foam insert removably received against the base and inter-locked with the plastic sleeve, a covered portion of the foam insert positioned within the gap and covered by the overlapping portion of the plastic sleeve, and a remainder of the foam insert being exposed.

There is disclosed a protective shoulder pad, comprising: an upper protective portion for covering upper parts of shoulders, a sternum protector extending downwardly from the upper protective portion for covering a sternum, and a spine protector extending downwardly from the upper protective portion for covering part of a spine, one or both of the sternum protector and the spine protector comprising: a foam insert having a front surface and a rear surface; and a plastic sleeve being harder than the foam insert and having a base and an overlapping portion spaced from the base to define a gap, the foam insert removably received against the base and inter-locked with the plastic sleeve, a covered portion of the foam insert positioned within the gap and covered by the overlapping portion of the plastic sleeve, a remainder of the foam insert being exposed.

There is disclosed a method of assembling a protective sport padding, the method comprising: removably inserting a foam insert into a plastic sleeve being harder than the foam insert to inter-lock the foam insert with the plastic sleeve and form part of the protective sport padding, part of a visible surface of the inserted foam insert covered by part of the plastic sleeve and a remainder of the visible surface of the inserted foam insert exposed to view.

There is disclosed a protective shoulder pad, comprising: an upper protective portion for covering upper parts of shoulders, a sternum protector extending downwardly from the upper protective portion for covering a sternum, and a spine protector extending downwardly from the upper protective portion for covering part of a spine, one or both of the sternum protector and the spine protector comprising: a foam insert having a front surface and a rear surface; and a plastic sleeve being harder than the foam insert and having a base and an overlapping portion spaced from the base to define a gap, the foam insert received against the base and inter-locked with the plastic sleeve, a covered portion of the foam insert positioned within the gap and covered by the overlapping portion of the plastic sleeve, a remainder of the foam insert being exposed.

There is disclosed a method of assembling a protective sport padding, the method comprising: removably inserting a foam insert into a plastic sleeve being harder than the foam insert to inter-lock the foam insert with the plastic sleeve, part of a visible surface of the inserted foam insert covered by part of the plastic sleeve and a remainder of the visible surface of the inserted foam insert exposed to view, and fixedly attaching the foam insert and the plastic sleeve to the protective sport padding.

There is disclosed a foam-plastic protector adapted to be worn, comprising: a foam insert having a front surface and a rear surface; and a plastic sleeve removably receiving the foam insert, the plastic sleeve being harder than the foam insert and having a base and an overlapping portion spaced from the base to define a gap, the foam insert received against the base and inter-locked with the plastic sleeve, a covered portion of the foam insert positioned within the gap and covered by the overlapping portion of the plastic sleeve, and a remainder of the foam insert being exposed.

BRIEF DESCRIPTION OF THE DRAWINGS

Reference is now made to the accompanying figures in which.

DETAILED DESCRIPTION

Figure 1:
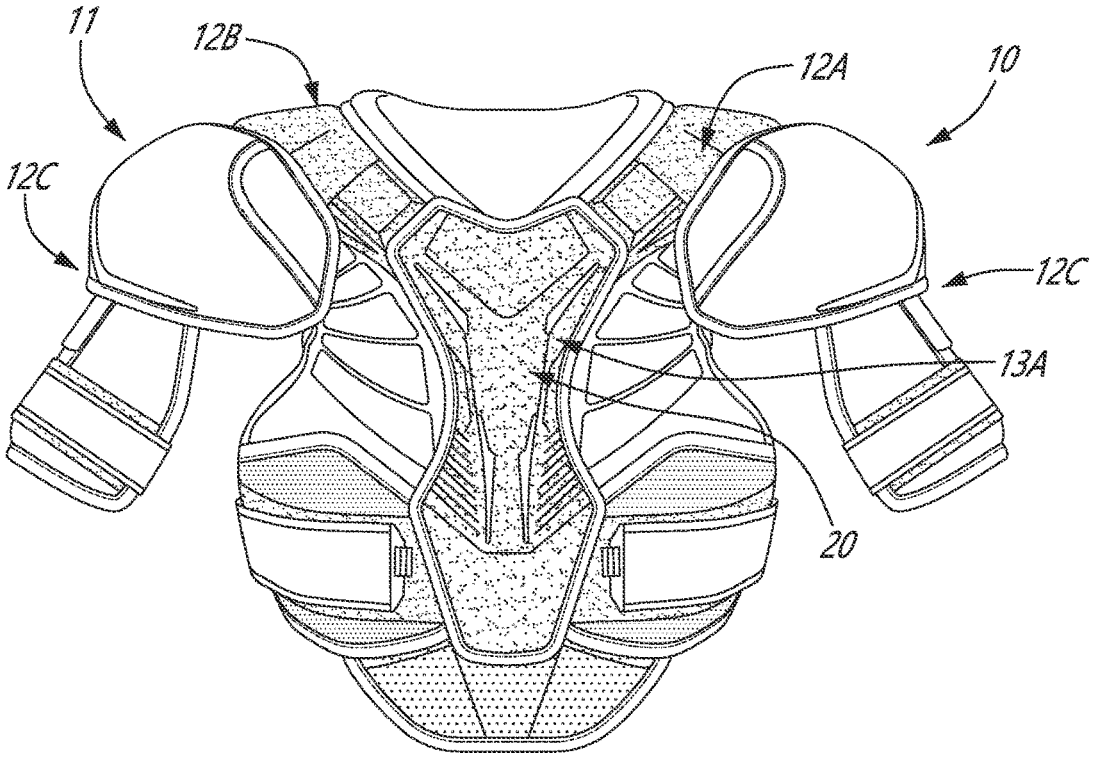
FIG. 1 is a front elevational view of a shoulder pad with foam-plastic protectors.

FIG. 1 illustrates a protective sport padding 10 for protecting part of the body of a player when playing sports. In FIG. 1, the protective sport padding 10 is a protective shoulder pad 11 configured to protect the shoulders of the player and part of their upper body. Other possible protective sport paddings 10 are within the scope of the present disclosure, and include but are not limited to, elbow pads, shin pads, and spine protectors of hockey pants.

The protective shoulder pad 11 (sometimes referred to herein simply as "shoulder pad 11") is an assembly of protective components which cooperate together to protect the underlying areas of the player. Some of these protective components are shown in FIG. 1, and include an upper protective portion 12A made of a foam for covering upper parts of the shoulders, chest and back, protective portions 12B for covering parts of the front and back of the upper body of the player, and upper arm protective portions 12C for covering parts of the upper arms of the player. Additional protective components of the shoulder pad 11 include a sternum protector 13A and a spine protector 13B (see FIG. 2A). The sternum protector 13A extends downwardly from the upper protective portion 12A over a front of the player's torso to overlie and cover some or all of the sternum, and the spine protector 13B or guard extends downwardly from the upper protective portion 12A over a back of the player's torso to overlie and cover some or all of an upper portion of the spine.

Figure 2A:
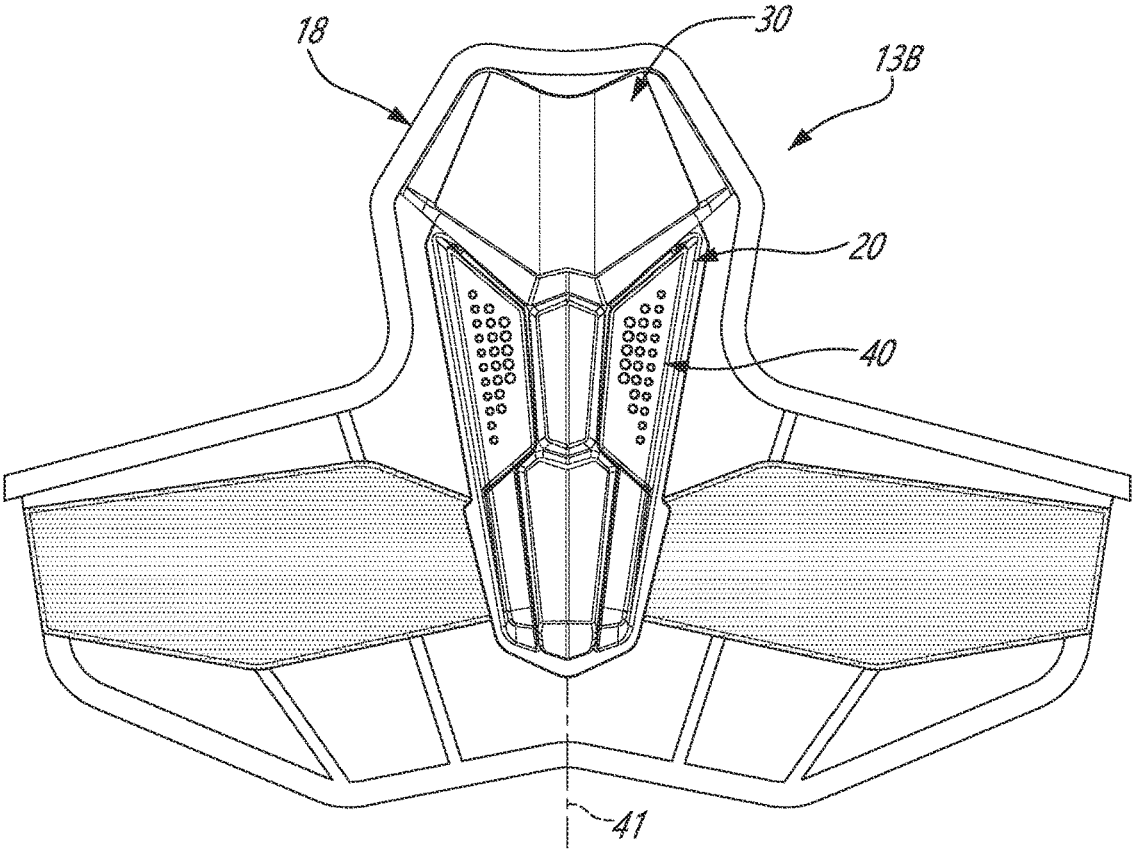
FIG. 2A is a top view of part of the shoulder part of FIG. 1 and one of the foam-plastic protectors.

FIG. 1 shows that the sternum protector 13A has a foam-plastic protector 20, and FIG. 2A shows that the spine protector 13B also has a foam-plastic protector 20. The foam-plastic protector 20 provides protection against impacts to those portions of the shoulder pad 11, and helps to reinforce them. The foam-plastic protector 20 is made up of a foam component referred to herein as a foam insert 30 and a harder, plastic component referred to herein as a plastic sleeve 40. The foam insert 30 is a body of foam material which is received in the plastic sleeve 40. The foam insert 30 is a body having cavities spread throughout its volume. The foam insert 30 is made in whole or in part from a foam material, for example a compressed, high-density foam. Some non-limiting examples of such foam material include polyethylene, Ethylene-Vinyl Acetate (EVA), and Expanded Polypropylene (EPP).

The plastic sleeve 40 is an elongated body that partially encloses, or wraps around, the foam insert 30. The plastic sleeve 40 is longer than it is wide in the illustrated embodiment. The plastic sleeve 40 extends along a longitudinal axis 41. Other shapes for the plastic sleeve 40 are possible, including shapes where it is wider than it is long, or rounded. The plastic sleeve 40 is made from a plastic material that is harder than the material of the foam insert 30. By "harder", it is understood that the material hardness value of the plastic sleeve 40 is greater than the material hardness value of the foam insert 30. The harder plastic sleeve 40 thus forms a structural frame of the foam-plastic protector 20 that partially encases and protects the softer foam insert 30 received within the plastic sleeve 40. The plastic sleeve 40 forms an outer, more rigid part of the foam-plastic protector 20. The plastic sleeve 40 may be made from any suitable plastic or composite material that provides the above-described functionality. One possible and non-limiting example of the material of the plastic sleeve is injected molded polyethylene.

Figure 2B:
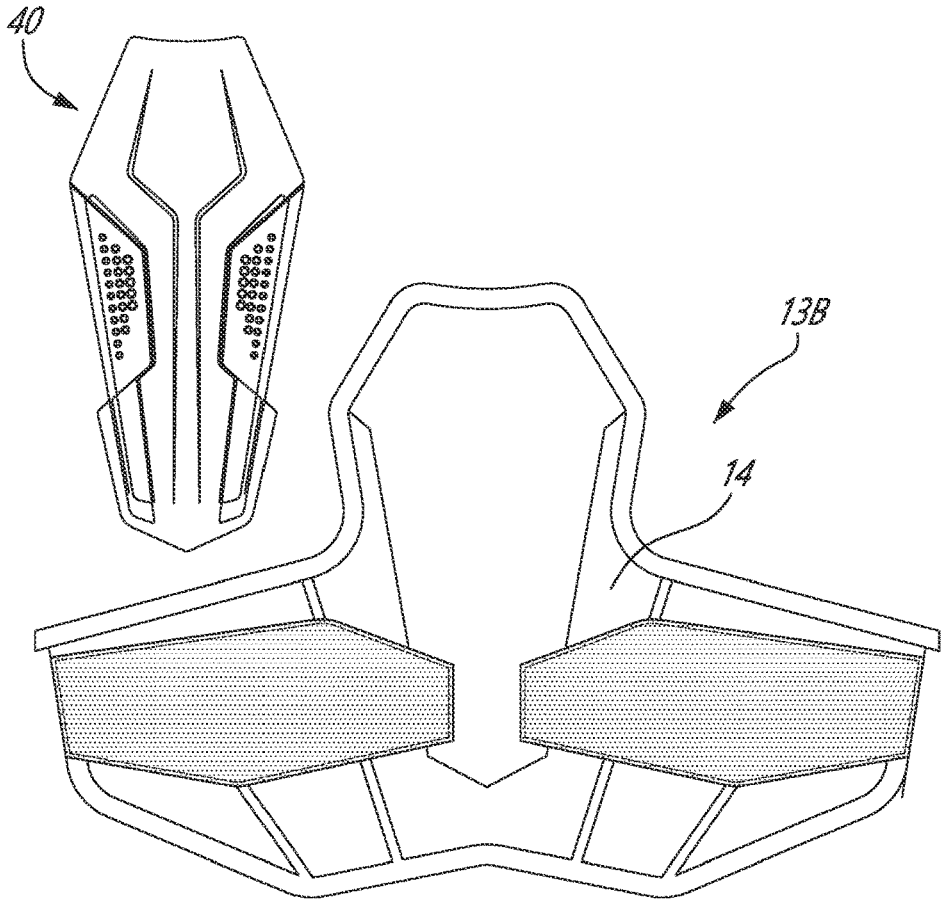
FIG. 2B is a disassembled view of part of the foam-plastic protector and part of the shoulder pad of FIG. 2A.
Figure 2C:
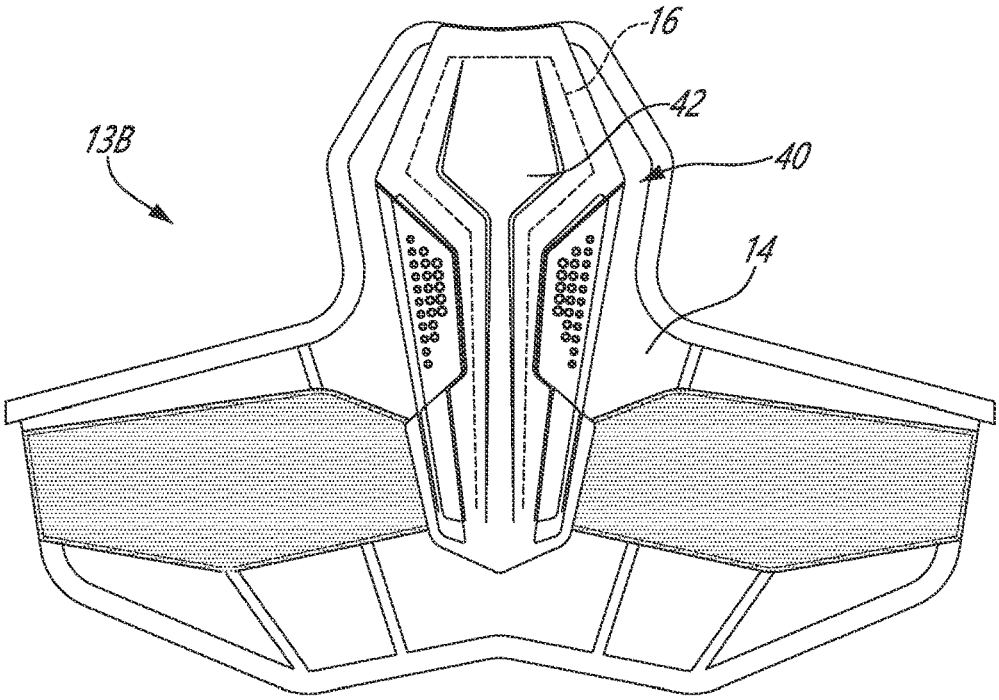
FIG. 2C is an assembled view of the same part of the foam-plastic protector and the same part of the shoulder pad of FIG. 2B.

In FIG. 2B, the plastic sleeve 40 is shown separate from a foam base 14 of the spine protector 13B. In FIG. 2C, a base 42 of the plastic sleeve 40 is shown fastened to the foam base 14 along a line of attachment 16, in order to secure the plastic sleeve 40 to the spine protector 13B. The base 42 may be stitched, riveted, stapled, adhered or joined in any other suitable way to the foam base 14 along the line of attachment 16. The line of attachment 16 is positioned inwardly of a periphery of the base 42. The plastic sleeve 40 may therefore first be attached or joined to the protective sport padding 10 before the foam insert 30 is inserted into the plastic sleeve 40. Placing the line of attachment 16 along the base 42 allows for the line of attachment 16 to be concealed when the foam insert 30 is inserted into the plastic sleeve 40 over the base 42. The plastic sleeve 40 is therefore attachable to a protective sport padding 10 in a way that conceals how it is attached. Referring to FIG. 2A, a binding 18 is applied along an edge of the shoulder pad 11 to secure the edges and complete the assembly of the shoulder pad 11.

In an alternate embodiment, only one of the sternum and spine protectors 13A,13B has the foam-plastic protector 20. Similarly, although shown in FIGS. 1 and 2A as being identical, the foam-plastic protectors 20 of the sternum and spine protectors 13A,13B are different from each other in another embodiment in one or more of shape, size, and configuration. It will also be appreciated that the foam-plastic protector 20 may be used with any protective sport padding 10 that might benefit from the combination of a foam portion with a more structural plastic component. For example, in protective gear used in the sport of hockey, the protective sport padding 10 for the forearms and biceps (elbow pads), back ribs, calves (shin pads), or any other body parts that require additional protection may use, or incorporate, the foam-plastic protector 20.

Figure 3A:
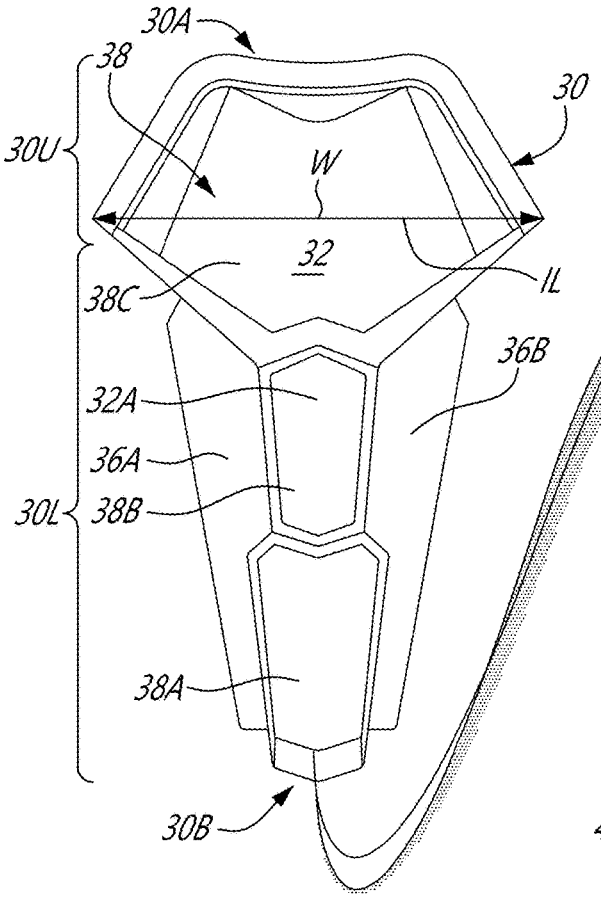
FIG. 3A is a disassembled view of a foam insert and a plastic sleeve of one of the foam-plastic protectors of FIG. 1.

The structure of the foam insert 30 and the plastic sleeve 40, as well as the relationship between these two components, is described in greater detail with reference to FIGS. 3A to 3D. Referring to FIG. 3A, the foam insert 30 has a front surface 32 part of which is visible when the foam insert 30 is assembled as part of the foam-plastic protector 20. The foam insert 30 also has a rear surface 34 (see FIGS. 4C-4E) that is disposed on an opposite side of the body of the foam insert 30 from the front surface 32. Some or all of the rear surface 34 is hidden from view by the base 42 of the plastic sleeve 40 when the foam insert 30 is assembled as part of the foam-plastic protector 20. The rear surface 34 faces and engages the base 42 of the plastic sleeve 40 when the foam insert 30 is assembled as part of the foam-plastic protector 20. The rear surface 34 faces the shoulder pad 11 when the foam insert 30 is assembled as part of the foam-plastic protector 20.

Referring to FIGS. 3A to 3D, the base 42 of the plastic sleeve 40 is a backing of the foam-plastic protector 20 against which the foam insert 30 is applied and rests. The base 42 therefore reinforces and protects the rear surface 34 of the foam insert 30. The base 42 extends along the longitudinal axis 41. A central rib 42A of the base 42 projects outwardly from recessed walls 42B of the base 42. The central rib 42A and recessed walls 42B are symmetrical about the longitudinal axis 41. The central rib 42A tapers in thickness or height to have the same thickness or height as the recessed walls 42B at one end of the base 42. Other shapes, configurations, and components for the base 42 are possible. As shown in FIG. 3A, the foam insert 30 is received between the base 42 and the overlapping portions 44A, 44B. The overlapping portions 44A, 44B are thus used to retain the foam insert 30 in abutment against the base 42. Consequently, once the foam insert 30 is coupled to the plastic sleeve 40, the overlapping portions 44A, 44B will cover a portion of the foam insert 30 (see FIG. 3A). As illustrated, the foam insert 30 extends longitudinally between an upper end 30A and a lower end 30B. The foam insert 30 has a thickness T (FIG. 4E) between the front surface 32 and the rear surface 34 and a width W (FIG. 3A) in a direction being transverse to the thickness T. The width W of the foam insert 30 increases from the upper end 30A to an intermediate location IL disposed between the upper end 30A and the lower end 30B. The width W of the foam insert 30 decreases from the intermediate location IL to the lower end 30B. A maximum width of the foam insert 30 is defined at the intermediate location IL. The foam insert 30 has an upper portion 30U (FIG. 3A) between the upper end 30A and the intermediate location IL and a lower portion 30L (FIG. 3A) between the intermediate location IL and the lower end 30B.

Figure 4A:
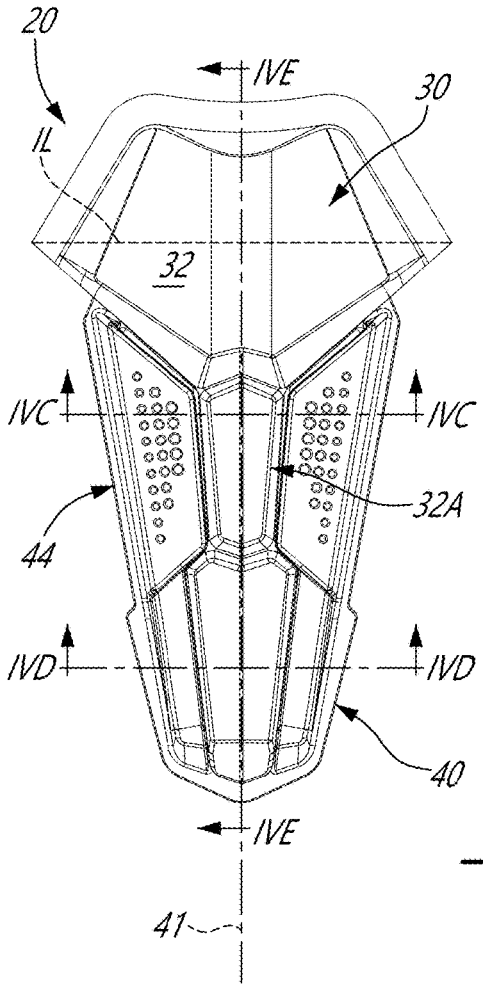
FIG. 4A is an front elevational view of one of the foam-plastic protectors of FIG. 1, showing the foam insert assembled with the plastic sleeve.
Figure 4E:
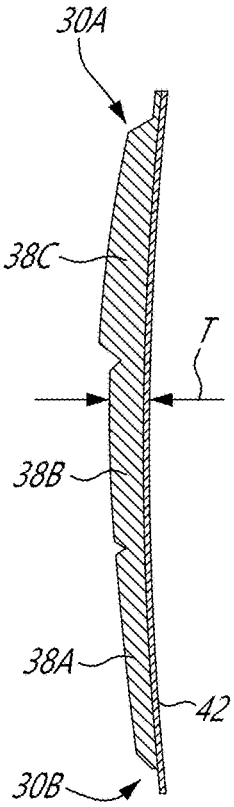
FIG. 4E is a cross-sectional view of the foam-plastic protector taken along the line IVE-IVE in FIG. 4A.
Figure 4B:
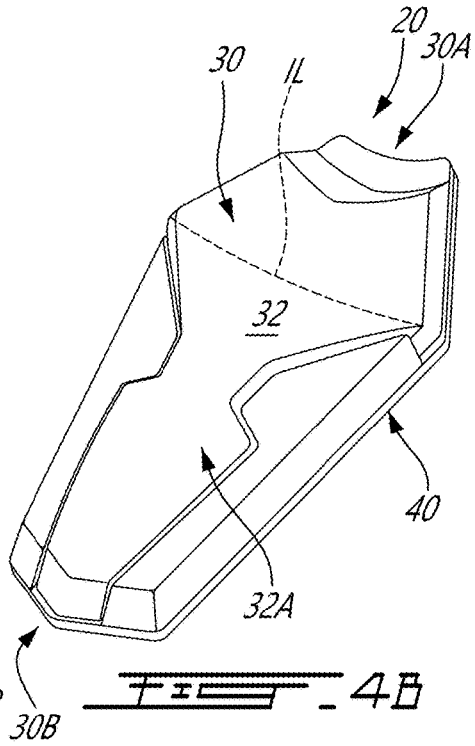
FIG. 4B is a perspective view of the foam-plastic protector of FIG. 4A.
Figure 4C:
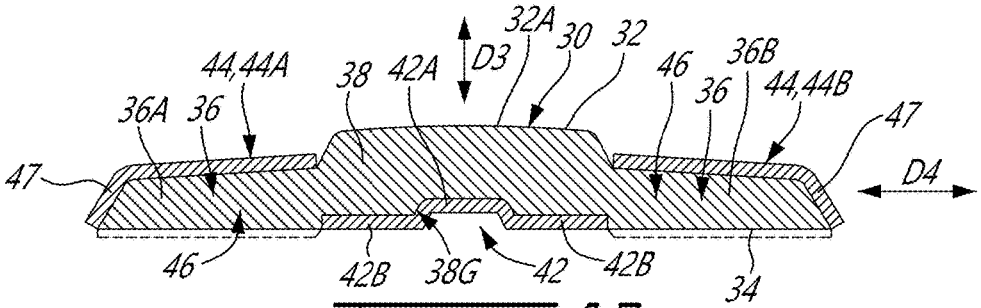
FIG. 4C is a cross-sectional view of the foam-plastic protector taken along the line IVC-IVC in FIG. 4A.
Figure 4D:
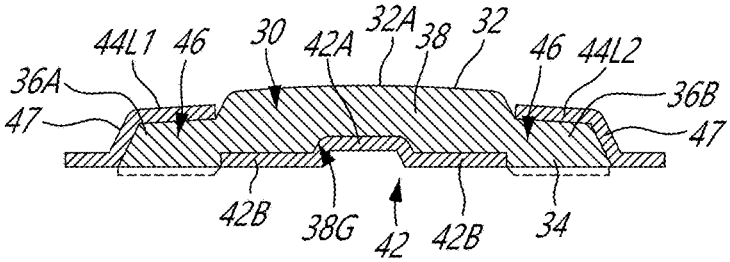
FIG. 4D is a cross-sectional view of the foam-plastic protector taken along the line IVD-IVD in FIG. 4A.

Referring to FIGS. 4C and 4D, at one or more points along the longitudinal axis 41 of the plastic sleeve 40, some of the rear surface 34 of the foam insert 30 abuts against the base 42. This portion of the rear surface 34 is therefore covered or shielded by this part of the base 42. For example, in the cross-sectional views of FIGS. 4C and 4D taken along the lines IVC-IVC and IVD-IVD, respectively, in FIG. 4A at different points along the length of the plastic sleeve 40, some of the rear surface 34 of the foam insert 30 abuts against all of the central rib 42A and all of the recessed walls 42B, while a remainder of the rear surface 34 of the foam insert 30 does not abut against any part of the base 42. In an alternate embodiment, all of the rear surface 34 of the foam insert 30 abuts against the base 42. In such an embodiment, all of the rear surface 34 is therefore covered or shielded by the base 42. An example of this embodiment is shown in the cross-sectional views of FIGS. 4C and 4D, where extended recessed walls 42B are shown in dotted lines. In such an embodiment, all of the rear surface 34 of the foam insert 30 abuts against all of the central rib 42A and all of the extended recessed walls 42B, leaving no part of the rear surface 34 of the foam insert 30 exposed.

Figure 3B:
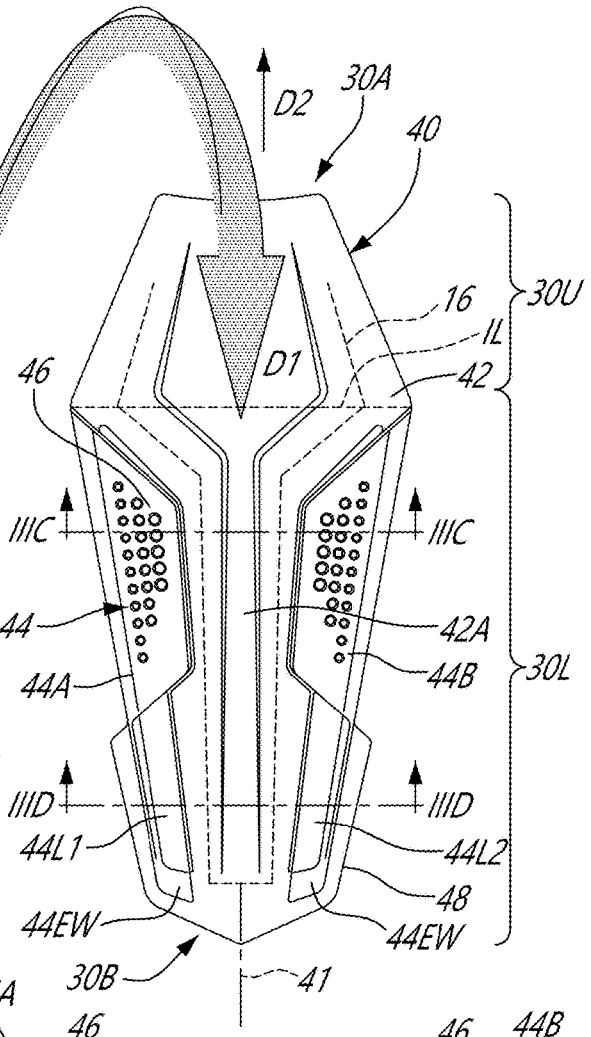
FIG. 3B is a perspective view of the plastic sleeve of FIG. 3A.
Figure 3B:
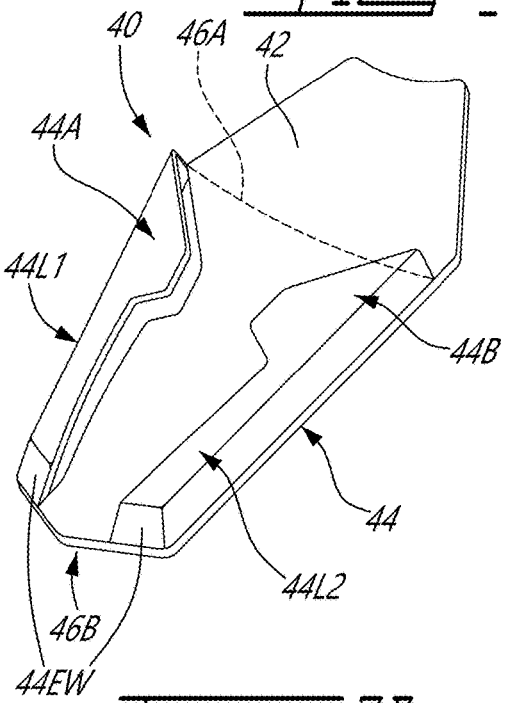

Referring to FIGS. 3A to 3D, the plastic sleeve 40 has an overlapping portion 44, which may also be referred to as a cover. The overlapping portion 44 is spaced apart from the base 42 to define a gap, or a receiving space, 46 between the overlapping portion 44 and the base 42. The cover 44 and the base 42 are spaced apart to conjointly define the receiving space 46 sized to receive therein the foam insert 30. The receiving space 46 extends along the longitudinal axis 41 from an open end 46A via which the foam insert 30 is received to a closed end 46B located further away from the upper protective portion 12A than the open end 46A. The receiving space 46 decreases in width from the open end 46A to the closed end 46B. As shown in FIG. 3B, the cover 44 overlaps solely the lower portion 30L of the foam insert 30. The intermediate location IL of the foam insert 30 is in register with the open end 46A of the plastic sleeve 40 and the upper portion 30U of the foam insert 30 extends outside the receiving space 46. In FIGS. 3A to 3D, the overlapping portion 44 is spaced apart from the base 42 in a direction that is normal to a plane defined by the base 42. The overlapping portion 44 overlaps, and shields, some of the front surface 32 of the foam insert 30 when part of the foam insert 30 is within the gap 46 of the plastic sleeve 40. The overlapping portion 44 therefore conceals some of the front surface 32, while leaving a remainder of the front surface 32 exposed to view.

The relationship between the overlapping portion 44 and the front surface 32 of the foam insert 30 is more clearly shown in FIGS. 4A to 4D. A covered portion 36 of the foam insert 30 is concealed by the overlapping portion 44 when the covered portion 36 is positioned in the gap 46. In FIGS. 4C and 4D, the covered portion 36 abuts against an inner surface of the overlapping portion 44. FIGS. 4A and 4B show the remainder of the foam insert 30 that is exposed to view, referred to herein as the visible segment 32A of the front surface 32 of the foam insert 30. Therefore, when the plastic sleeve 40 and the foam insert 30 are assembled to form the foam-plastic protector 20, the plastic sleeve 40 partially surrounds the foam insert 30 such that some of the front of the foam insert 30 is exposed. The plastic sleeve 40 surrounds the foam insert 30 to help provide structure and rigidity to the softer foam "core" of the foam-plastic protector 20.

The assembly of the foam insert 30 with the plastic sleeve 40 is performed by displacing the foam insert 30 relative to the plastic sleeve 40. Referring to FIG. 3A, the rear surface 34 of the foam insert 30 is removably received against some or all of the base 42 such that they are in contact. By "removably received", it is understood that the foam insert 30 can be easily removed from the plastic sleeve 40 by displacing the foam insert 30 relative to the plastic sleeve 40. In some embodiments, and as shown in FIGS. 3A-4D, the attachment between the foam insert 30 and the plastic sleeve 40 is free of permanent fixation or adherence. It thus follows that the attachment between the foam insert 30 and the plastic sleeve 40 is free of being fastened together (e.g. by glue, stitching, riveting or other mechanical attachment). Since no mechanical fastener needs to be removed and since no adhesive needs to be neutralized, the foam insert 30 is readily separated from the plastic sleeve 40 so that it can be inspected, repaired or replaced in the embodiment shown in FIGS. 3A-4D. In FIG. 3A, the foam insert 30 is slid into the plastic sleeve 40 along a direction of insertion D1 such that the rear surface 34 slides along the base 42 and relative thereto. The direction of insertion D1 is transverse to the width W (FIG. 3A).

Despite being removably assembled and easily separable, when the foam insert 30 is received within the plastic sleeve 40, the two components are inter-locked. By "inter-locked", it is understood that further displacement of the foam insert 30 relative to the plastic sleeve 40 is prevented along almost all directions when the foam insert 30 is received within the plastic sleeve 40, despite there being no permanent attachment between these components. The foam insert 30 and plastic sleeve 40 have cooperating features which allow these components to inter-lock and prevent the most common occasions of unwanted separation of these components, while still allowing the foam insert 30 to be easily removed from the plastic sleeve 40, prior to any possible attachment of the foam insert 30 to the protective sport padding 10, as described in greater detail below. Some possible cooperating features are described in greater detail below.

One possible example of the inter-locking of the assembled foam insert 30 and plastic sleeve 40 is shown in FIG. 3A. The foam insert 30 is displaced along the direction of insertion D1 to be removably inserted into the gap 46 of the plastic sleeve 40. When the foam insert 30 is removably received against the base 42, the inter-locking of the foam insert 30 and the plastic sleeve 40 prevents displacement of the foam insert 30 relative to the plastic sleeve 40 in all directions except a direction D2 that is opposite to the direction of insertion D1. In this example of inter-locking, the foam insert 30 may therefore only be removed from the gap 46—and the foam-plastic protector 20 thus disassembled—by displacing the foam insert 30 relative to the plastic sleeve 40 along the direction D2. The prevention of relative displacement between the inter-locked foam insert 30 and plastic sleeve 40 is also described further below.

The components of the foam-plastic protector 20 (i.e. the foam insert 30 and the plastic sleeve 40) are therefore easy to assemble and disassemble prior to any possible attachment of the foam insert 30 to the protective sport padding 10. Despite this ease of disassembly, the foam insert 30 and the plastic sleeve 40 remain inter-locked when assembled such that the most common occasions of unwanted separation of these components are prevented. Some conventional applications combining foam and more rigid reinforcement, in contrast, require the use of glue, stitching, and/or fabric binding, in order to keep the foam and the rigid component together. The foam insert 30 and the plastic sleeve 40 do not need to be sewn, glued or mechanically assembled together. Furthermore, the foam-plastic protector 20 may look seamlessly integrated with the finished protective sport padding 10, as shown in FIG. 1, since the assembling of the foam-plastic protector 20 will be hidden to the user. The foam-plastic protector 20 may be applied to any protective sport padding 10 that needs to combine a foam with a more structural component such as plastic or composite materials. In the field of protective gear for the sport of hockey, which is just one example of a sport in which the foam-plastic protector 20 may be used, the benefits of the foam-plastic protector 20 may be used to create protectors 20 for the forearms, biceps, back ribs, calves, or any other body parts that require additional protection.

Possible and non-limiting configurations of the overlapping portion 44 and the covered portion 36 of the foam insert 30 are shown in FIGS. 3A to 3D. The overlapping portion 44 includes a first overlapping portion 44A and a second overlapping portion 44B. The first and second overlapping portions 44A,44B are disposed on opposite lateral sides of the plastic sleeve 40. Each of the first and second overlapping portions 44A,44B is a wing or a fold of the plastic sleeve 40 which overlies the covered portion 36 of the foam insert 30. The first and second overlapping portions 44A, 44B are spaced apart from each other in lateral direction to leave a central portion of the plastic sleeve 40 adjacent to the longitudinal axis 41 exposed, thereby allowing the visible segment 32A of the front surface 32 of the foam insert 30 to be seen when the foam insert 30 is received in the plastic sleeve 40. The first and second overlapping portions 44A, 44B are disposed on the opposite lateral sides of the plastic sleeve 40 symmetrically about the longitudinal axis 41. In the configuration shown in FIG. 3A, the first and second overlapping portions 44A,44B have a trapezoidal shape, and are positioned to span across a longitudinal mid-point of the plastic sleeve 40. The first and second overlapping portions 44A,44B are perforated, which may help the assembler of the foam-plastic protector 20 confirm when the foam insert 30 is properly positioned and inter-locked with the plastic sleeve 40. The perforations may also contribute to the aesthetics of the plastic sleeve 40. Referring to FIG. 4C, the height of the exposed face of the first and second overlapping portions 44A,44B is less than the height of the exposed visible segment 32A of the front surface 32. Other configurations, positions and shapes for the first and second overlapping portions 44A,44B are possible.

FIGS. 3A to 3D show additional overlapping portions 44 of the plastic sleeve 40. Lower overlapping portions 44L1, 44L2 are disposed below the first and second overlapping portions 44A,44B. The lower overlapping portions 44L1, 44L2 are spaced apart from each other in a lateral direction to leave a central portion of the plastic sleeve 40 adjacent to the longitudinal axis 41 exposed, thereby allowing the visible segment 32A of the front surface 32 of the foam insert 30 to be seen when the foam insert 30 is received in the plastic sleeve 40. The innermost edges of the lower overlapping portions 44L1,44L2 are spaced further from the longitudinal axis 41 than the innermost edges of the first and second overlapping portions 44A,44B. The lower overlapping portions 44L1,44L2 are disposed on the opposite lateral sides of the plastic sleeve 40 symmetrically about the longitudinal axis 41. In the configuration shown in FIG. 3A, the lower overlapping portions 44L1,44L2 have an elongated shape, and are positioned along only one of the end portions of the plastic sleeve 40. Referring to FIG. 4D, the height of the exposed face of the lower overlapping portions 44L1,44L2 is less than the height of the exposed visible segment 32A of the front surface 32. Each lower overlapping portions 44L1,44L2 has an end wall 44EW which is closed and delimits part of the gap 46 defined by the overlapping portions 44A,44B,44L1,44L2. A peripheral skirt 48 extends outwardly away from the longitudinal axis 41 from the lower overlapping portions 44L1,44L2 to define part of the periphery of the plastic sleeve 40. Other configurations, positions and shapes for the lower overlapping portions 44L1,44L2 are possible.

Figure 3C:
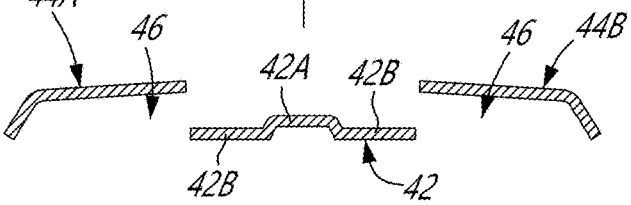
FIG. 3C is a cross-sectional view of the plastic sleeve taken along the line IIIC-IIIC in FIG. 3A.
Figure 3D:
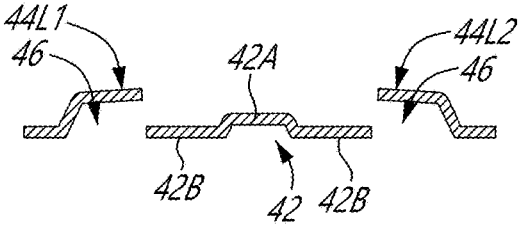
FIG. 3D is a cross-sectional view of the plastic sleeve taken along the line IIID-IIID in FIG. 3A.

Referring to FIGS. 3B to 3D, the overlapping portions 44A,44B,44L1,44L2 are spaced apart from a plane defined by the recessed walls 42B. The gap 46 defined between the overlapping portions 44A,44B,44L1,44L2 and the recessed walls 42B is open underneath the overlapping portions 44A,44B,44L1,44L2 where the recessed walls 42B do not extend. The plastic sleeve 40 is thus "open" along the bottom of the overlapping portions 44A,44B,44L1,44L2, which may facilitate insertion of the covered portion 36 of the foam insert 30 into the gap 46.

Referring to FIG. 3A, the covered portion 36 of the foam insert 30 includes a first covered portion 36A and a second covered portion 36B. The first and second covered portions 36A,36B are positioned on opposite lateral sides of the foam insert 30 and form peripheral wings or skirts of the foam insert 30. The first and second covered portions 36A,36B are disposed on the opposite lateral sides of the foam insert 30 symmetrically about the longitudinal axis 41 when the foam insert 30 is positioned within the plastic sleeve 40. The first and second covered portions 36A,36B are disposed in the gap 46 and covered by the overlapping portions 44A,44B, 44L1,44L2 of the plastic sleeve 40 (see FIGS. 4C and 4D). In the configuration shown in FIG. 3A, the first and second covered portions 36A,36B are positioned to span across a longitudinal mid-point of the foam insert 30 and to one of its ends. The foam insert 30 also has a central portion 38 positioned between the first and second covered portions 36A,36B and exposed to view. The central portion 38 spans the entire length of the foam insert 30 and defines the visible segment 32A of the front surface 32. The remainder of the front surface 32 is defined by the first and second covered portions 36A,36B and is hidden from view when the first and second covered portions 36A,36B are disposed in the gap 46. Referring to FIGS. 4C and 4D, the visible segment 32A of the central portion 38 is higher than the first and second covered portions 36A,36B. The visible segment 32A of the central portion 38 is spaced further from the base 42 than the first and second covered portions 36A,36B. The central portion 38 is spaced further from the base 42 than the overlapping portions 44A,44B,44L1,44L2. In FIG. 3A, the central portion has a lower segment 38A, a middle segment 38B, and an upper segment 38C separated from each other by a groove or gap. Referring to FIGS. 4C and 4D, the central portion 38 has a groove 38G along the longitudinal axis 41 when the foam insert 30 is received in the plastic sleeve 40. The groove 38G is sized and shaped to receive the recessed walls 42B and the central rib 42A of the base 42. Other configurations, positions and shapes for the first and second covered portions 36A,36B and the central portion 38 are possible.

Having described some of the possible features of the foam insert 30 and the plastic sleeve 40, the cooperating structural features of the foam insert 30 and the plastic sleeve 40 which allow for their inter-locked relationship will be more clearly understood. For example, and referring to FIG. 3A, one of the ends of the first and second covered portions 36A,36B of the foam insert 30 abuts against the end walls 44EW of the lower overlapping portions 44L1,44L2 of the plastic sleeve 40. This abutment prevents further displacement of the foam insert 30 relative to the plastic sleeve 40 in the direction of insertion D1, thereby helping to inter-lock the foam insert 30 and the plastic sleeve 40 in this direction of motion. In another example of inter-locking cooperation, and referring to FIGS. 4C and 4D, the first and second covered portions 36A,36B of the foam insert 30 are overlaid by the overlapping portions 44A,44B,44L1,44L2 of the plastic sleeve 40. This prevents displacement of the foam insert 30 relative to the plastic sleeve 40 in the direction D3 which is transverse to the direction of insertion D1 and normal to the plane defined by the base 42, thereby helping to inter-lock the foam insert 30 and the plastic sleeve 40 in this direction of motion. In another example of inter-locking cooperation, and referring to FIGS. 4C and 4D, the overlapping portions 44A,44B,44L1,44L2 of the plastic sleeve 40 have side walls 47 which abut against the outer sides of the first and second covered portions 36A,36B of the foam insert 30. This prevents displacement of the foam insert 30 relative to the plastic sleeve 40 in the direction D4 which is transverse to both the direction D3 and the direction of insertion D1, thereby helping to inter-lock the foam insert 30 and the plastic sleeve 40 in this direction of motion. In another example of inter-locking cooperation, and referring to FIGS. 4C and 4D, the groove 38G of the central portion 38 of the foam insert 30 receives the recessed walls 42B and the central rib 42A of the base 42 of the plastic sleeve 40. This prevents displacement of the foam insert 30 relative to the plastic sleeve 40 in the direction D4, thereby helping to further inter-lock the foam insert 30 and the plastic sleeve 40 in this direction of motion.

It will therefore be appreciated that at least these cooperating structural features of the foam insert 30 and the plastic sleeve 40 provide an inter-locking relationship by preventing or restricting displacement of the foam insert 30 relative to the plastic sleeve 40 along every direction where unwanted separation of these components might occur, prior to a possible attachment of the foam insert 30 to the protective sport padding 10, except for the direction D2 opposite to the direction of insertion D1. Since relative displacement of these components along the direction D2 is still possible, the foam insert 30 can be easily separated from the plastic sleeve 40 prior to a possible attachment of the foam insert 30 to the protective sport padding 10. The directions of displacement that are prevented by the inter-locking relationship of the foam insert 30 and the plastic sleeve 40 may be chosen to be the directions of displacement which are most likely to cause unwanted separation of the foam insert 30 and the plastic sleeve 40 prior to a possible attachment of the foam insert 30 to the protective sport padding 10. By inter-locking the foam insert 30 and the plastic sleeve 40 to prevent relative displacement along these directions, the likelihood that the foam-plastic protector 20 will be disassembled unintentionally prior to a possible attachment of the foam insert 30 to the protective sport padding 10 is reduced or eliminated.

Figure 5A:
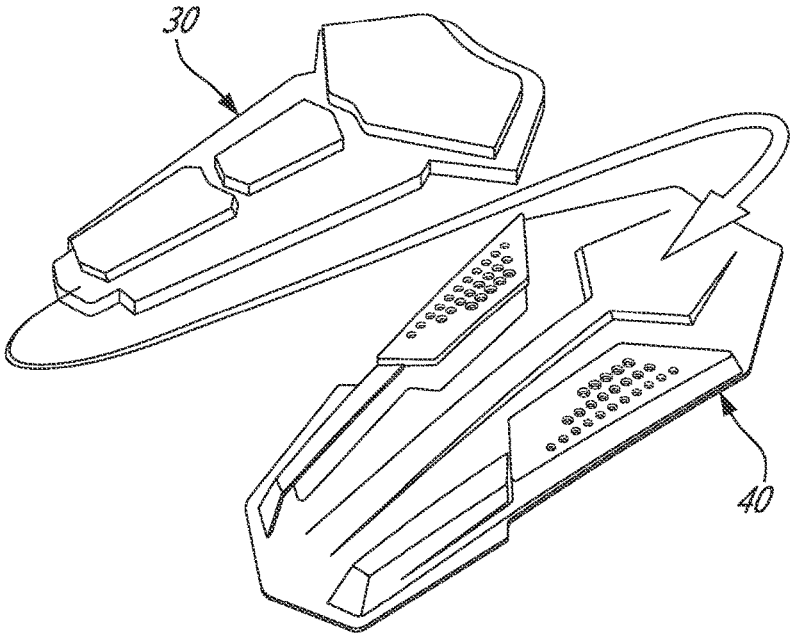
FIG. 5A is a disassembled perspective view of a foam insert and a plastic sleeve of one of the foam-plastic protectors of FIG. 1.
Figure 5B:
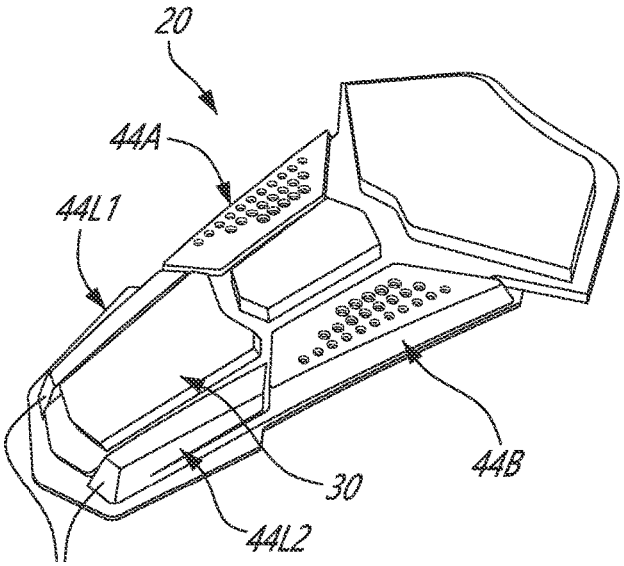
FIG. 5B is an assembled perspective view of the foam insert and the plastic sleeve of FIG. 5A.
Figure 5C:
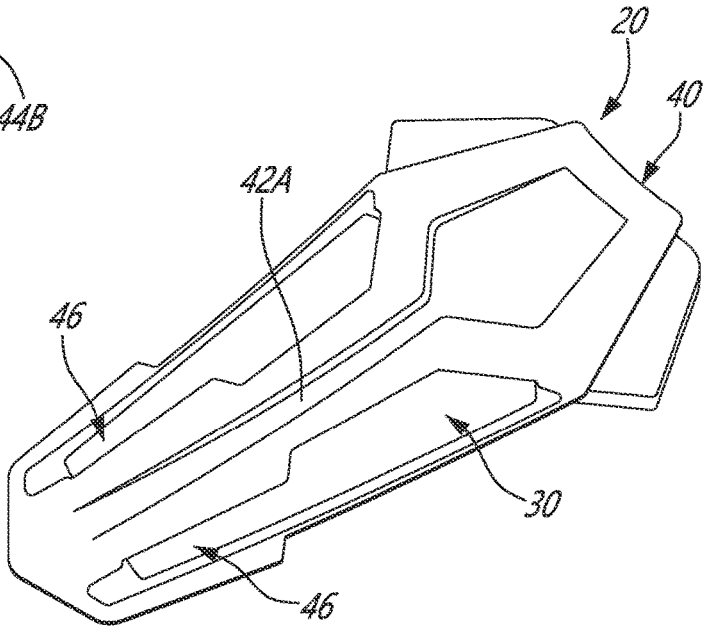
FIG. 5C is a rear perspective view of the assembled foam insert and plastic sleeve of FIG. 5B.

FIGS. 5A to 5C provide additional views of the foam-plastic protector 20 and its foam insert 30 and plastic sleeve 40. All of the features with reference numbers shown in other figures which are also shown in FIGS. 5A to 5C have the same reference numbers in FIGS. 5A to 5C, even if only some of these features are provided with reference numbers in FIGS. 5A to 5C. The underside or back of the foam-plastic protector 20 is shown in FIG. 5C. The central rib 42A is shown as a depression or recess in the base 42, and the "open end" of the gap 46 defined by the overlapping portions 44A,44B,44L1,44L2 is visible.

While it is possible and within the scope of the present disclosure for the protective sport padding 10 to be used with the foam insert 30 being removably mounted to the protective sport padding 10, so that a wearer of the protective sport padding 10 may easily repair or replace the foam insert 30 by removing it from the plastic sleeve 40, it may also be desirable to securely attach or affix the foam insert 30 to the protective sport padding 10. This helps to keep the foam insert 30 in its desired position on the protective sport padding 10 during use thereof. Thus, the foam insert 30 may be secured to the protective sport padding 10 after it has been assembled and interlocked with the plastic sleeve 40 to form the foam-plastic protector 20. However, and as mentioned above, the foam insert 30 may also be kept in its inter-locked and removable configuration within the plastic sleeve 40 during prolonged and repeated use of the protective sport padding 10, such that the foam insert 30 is never securely attached or affixed to the protective sport padding 10.

FIGS. 6A-6D show a configuration of the protective sport padding 110 which has a foam insert 130 fixedly attached to the protective sport padding 110. In FIGS. 6A-6D, the protective sport padding 110 is another configuration of the shoulder pad 111. All of the features with reference numbers shown in other figures which are also shown in FIGS. 6A-6D have the same reference numbers in FIGS. 6A-6D, even if only some of these features are provided with reference numbers in FIGS. 6A-6D, unless the features shown in FIGS. 6A-6D are provided with a different reference number.

Figure 6A:
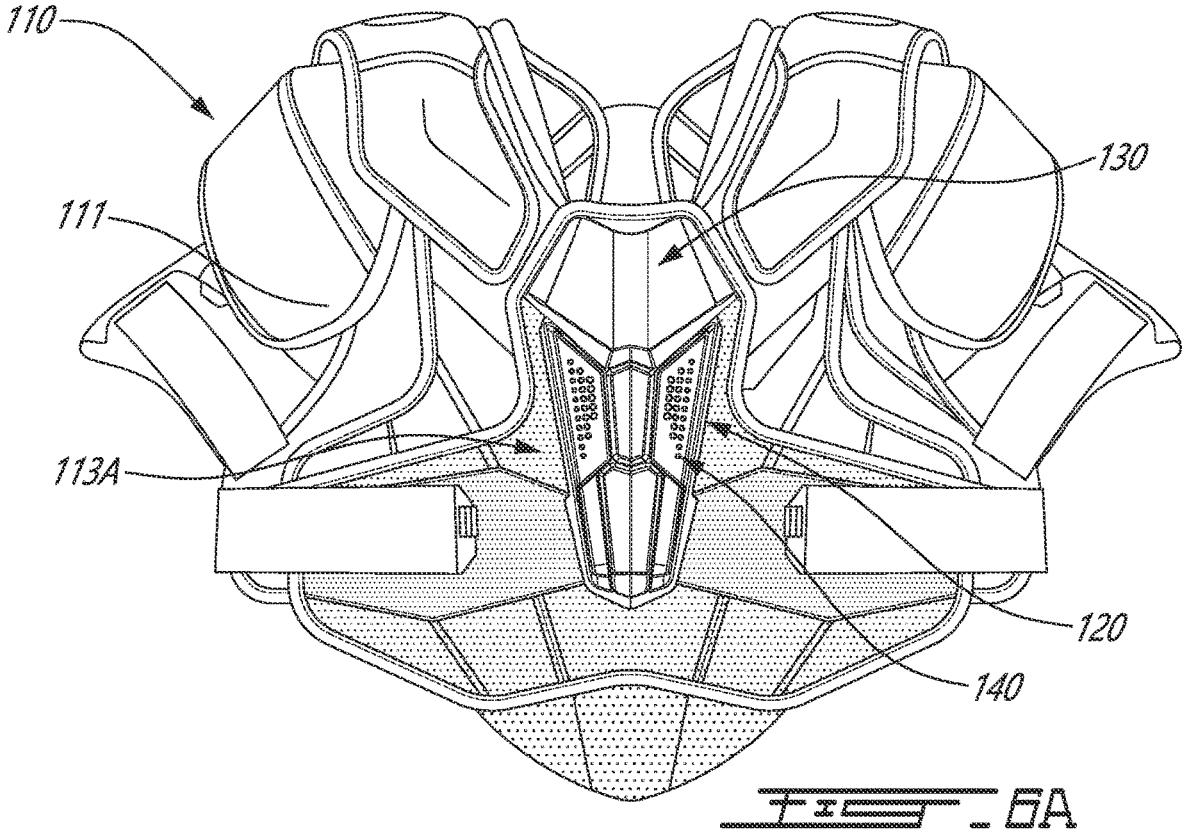
FIG. 6A is a front elevational view of a shoulder pad with foam-plastic protectors.
Figure 6B:
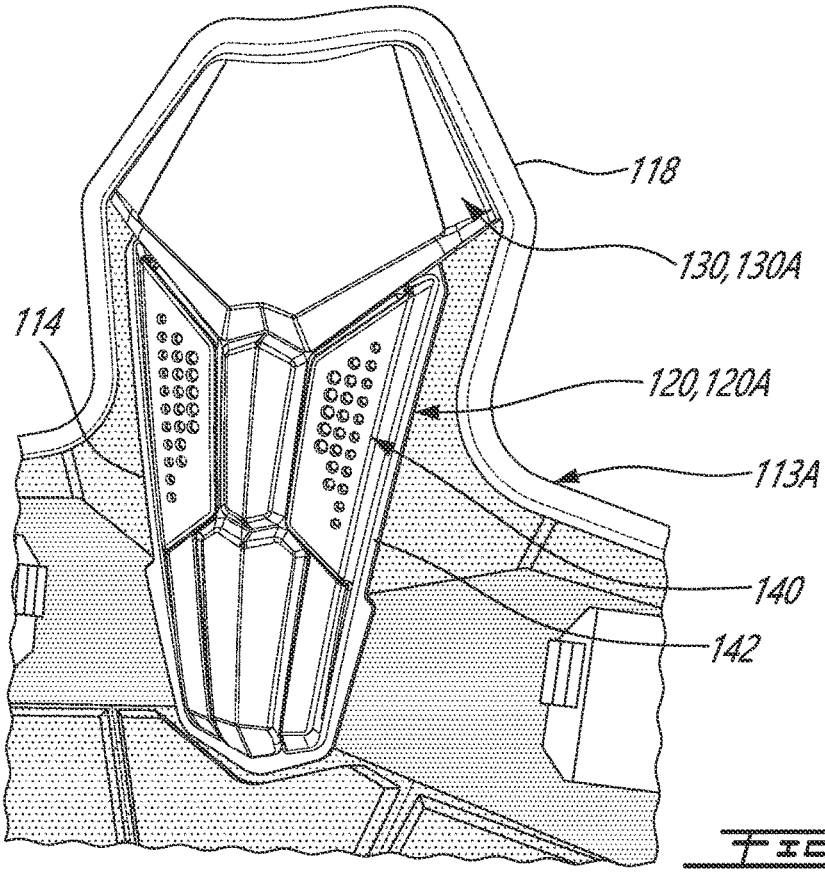
FIG. 6B is a front elevational view of one of the foam-plastic protectors of the shoulder pad of FIG. 6A.
Figure 6C:
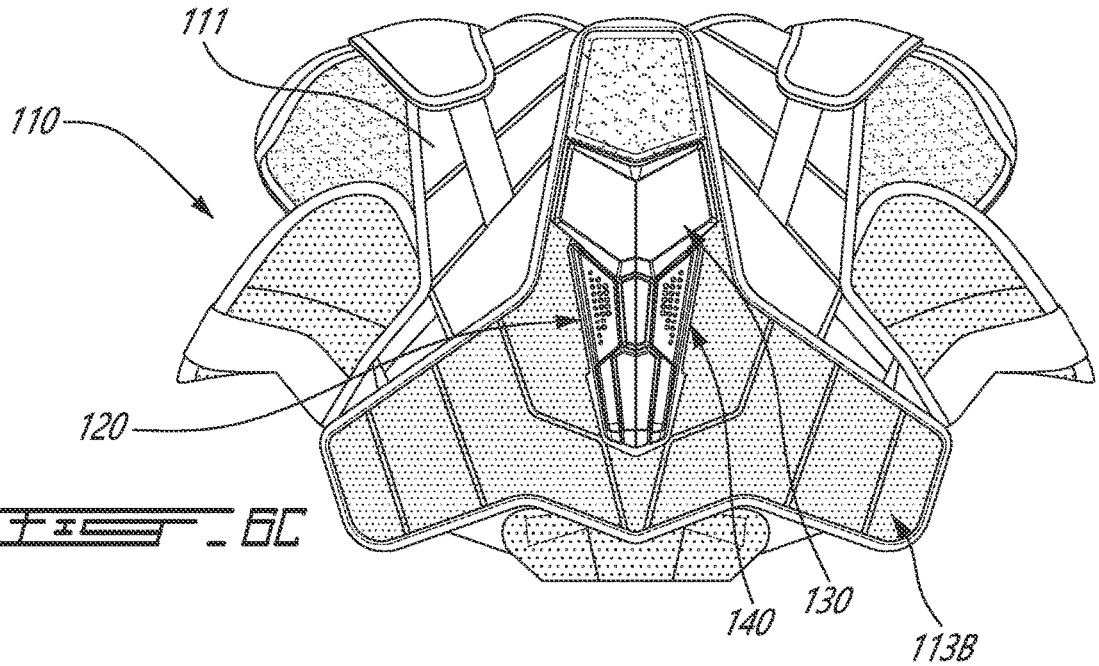
FIG. 6C is a rear elevational view of the shoulder pad of FIG. 6A.
Figure 6D:
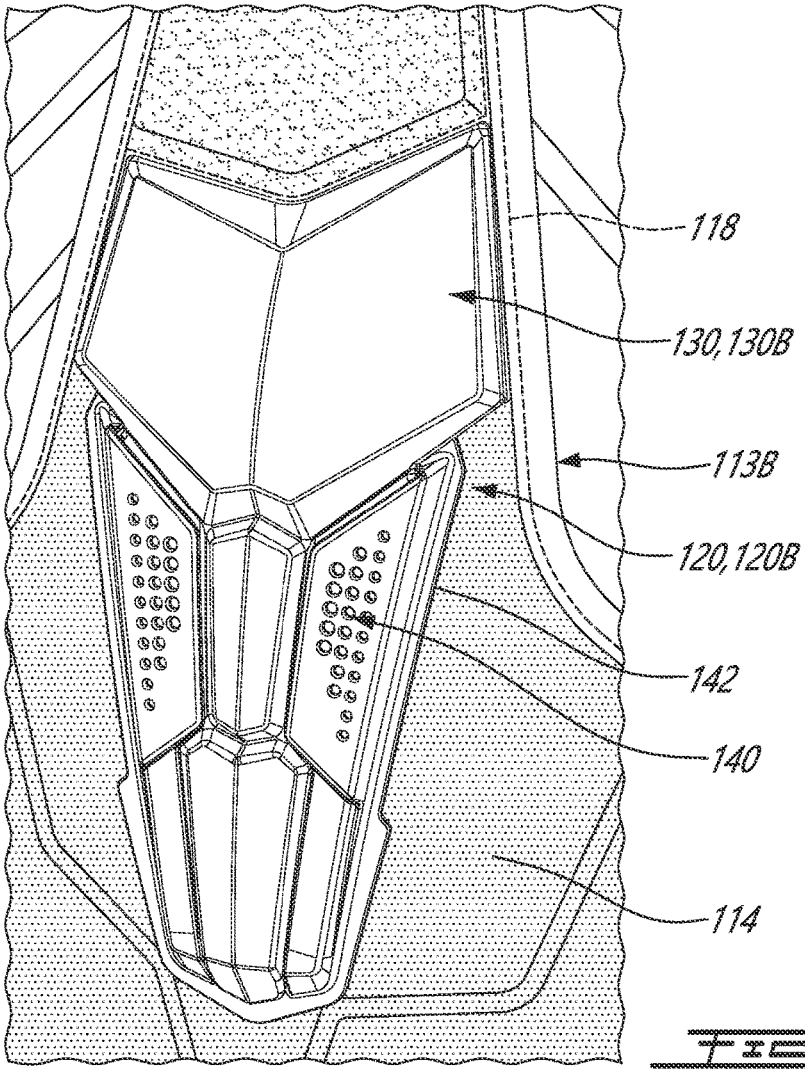
FIG. 6D is a rear elevational view of the foam-plastic protector shown in FIG. 6C.

FIGS. 6A and 6B show that the sternum protector 113A has a first foam-plastic protector 120A, and FIGS. 6C and 6D show that the spine protector 113B has a different, second foam-plastic protector 120B. The first and second foam-plastic protectors 120A,120B provide protection against impacts to those portions of the shoulder pad 111, and helps to reinforce them. The first and second foam-plastic protectors 120A,120B may differ in a variety of ways. For example, and referring to FIGS. 6B and 6D, the foam insert 130A of the first foam-plastic protector 120A has a shape that is different from the shape of the foam insert 130B of the second foam-plastic protector 120B. The foam insert 130B on the spine protector 113B has a higher profile than the foam insert 130A on the sternum protector 113A. The foam insert 130B on the spine protector 113B has a greater length than the foam insert 130A on the sternum protector 113A. The foam insert 130B on the spine protector 113B has an upper end closer to the neck of the user of the shoulder pad 111 than the foam insert 130A on the sternum protector 113A. In FIGS. 6A-6D, the plastic sleeves 140 of the first and second foam-plastic protectors 120A,120B are the same. In FIGS. 6A to 6D, the plastic sleeves 140 of the first and second foam-plastic protectors 120A,120B are identical. In FIGS. 6A-6D, the plastic sleeves 140 of the first and second foam-plastic protectors 120A,120B are the same, and the only difference between the first and second foam-plastic protectors 120A,120B is the difference between the foam inserts 130A,130B. Other types of differences between the first and second foam-plastic protectors 120A,120B are possible. For example, in another configuration, the plastic sleeves 140 of the foam-plastic protectors 120A,120B have a different shape or configuration, and the foam inserts 130 are the same.

In FIGS. 6A-6D, the foam inserts 130 are fixedly attached to the shoulder pad 111. By "fixedly" or "securely" attached, it is understood that the foam inserts 130 are fastened in a manner (e.g. by stitching, bonding, etc.) such that they cannot be easily removed from the shoulder pad 111, such as by being displaced relative to the plastic sleeve 140 and removed therefrom.

In FIGS. 6A and 6B, the plastic sleeve 140 is shown separate from the foam base 114 of the sternum protector 113A. In FIGS. 6C-6D, the plastic sleeve 140 is shown separate from the foam base 114 of the spine protector 113B. Referring to FIGS. 6A-6D, the bases 142 of the plastic sleeves 140 are fastened to the foam base 114 in order to secure the plastic sleeves 140 to the sternum and spine protectors 113A,113B. The bases 142 may be stitched, riveted, stapled, adhered or joined in any other suitable way to the foam base 114 along a line of attachment. The line of attachment may be positioned inwardly of a periphery of the bases 142. The plastic sleeves 140 are therefore attached or joined to the protective sport padding 110. Referring to FIGS. 6B and 6D, a binding 118 is applied along an edge of the foam inserts 130 to secure the foam inserts 130 to the foam base 114 of the protective sport padding 110. The binding 118 is thus an aesthetic finish along the edge of the foam inserts 130 that also prevents the foam inserts 130 from being removed from their plastic sleeve 140, and from the protective sport padding 110. The binding 118 helps to connect the foam inserts 130 and the foam base 114 securely together. Once the binding 118 is applied, the foam inserts 130 cannot be easily removed from their plastic sleeve 140. The binding 118 may be, or include, stitching, mechanical fasteners (e.g. rivets or staples), adhesive or any other suitable joining object or technique to achieve the functionality ascribed to the binding 118 herein.

Figure 6E:
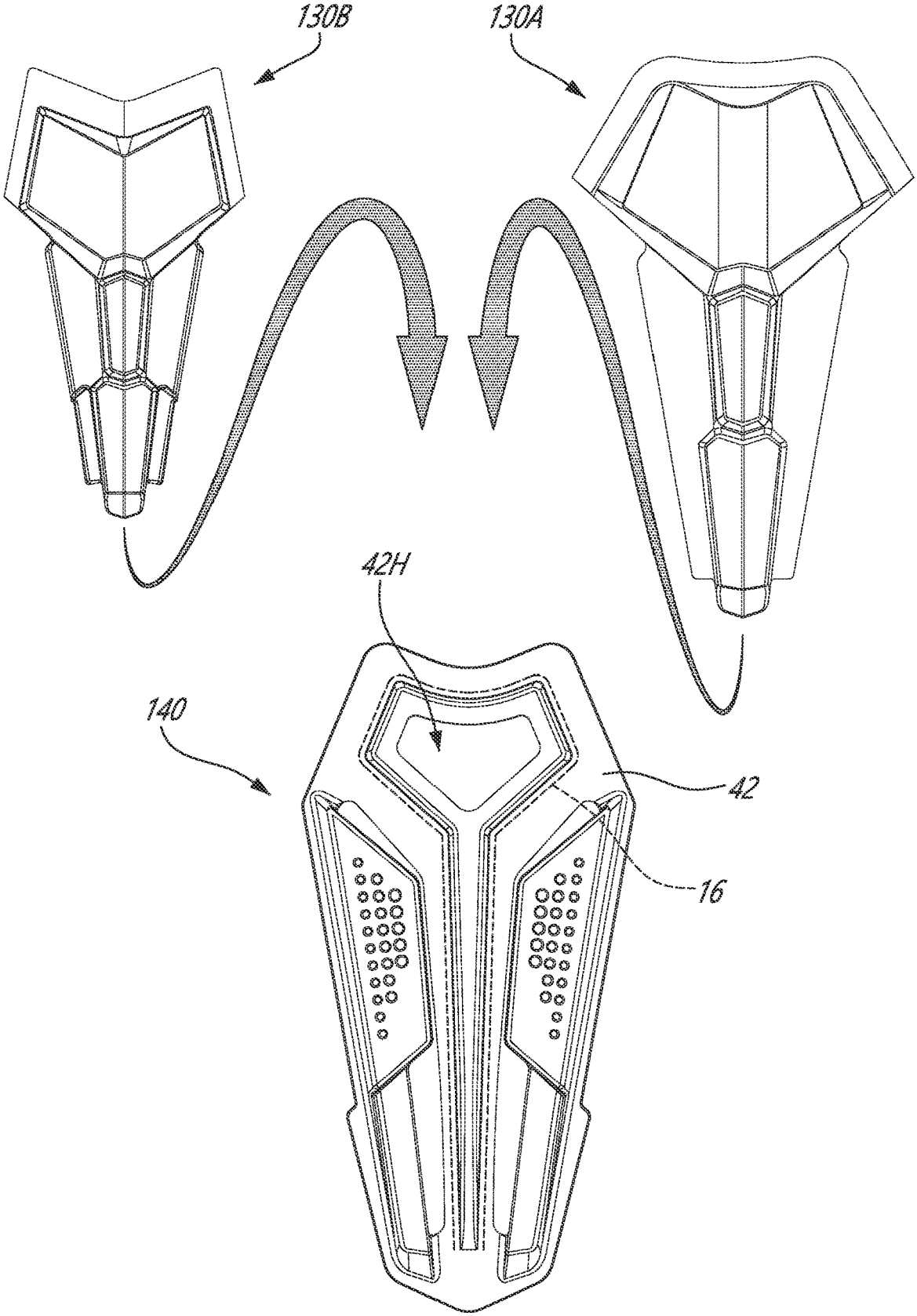
FIG. 6E is a disassembled view of foam inserts and a plastic sleeve of the foam-plastic protectors of FIG. 6A.

Referring to FIG. 6E, the foam insert 130A of the first foam-plastic protector 120A for the sternum protector 113A and the foam insert 130B of the second foam-plastic protector 120B for the spine protector 113B are shown as being different from one another and as being disassembled from the plastic sleeve 140. The plastic sleeve 140 is the same in both the first and second foam-plastic protectors 120A, 120B. The plastic sleeve 140 has a hole 42H extending through the base 42 at an upper portion of the base 42. The hole 42H is spaced inwardly from a periphery of the base 42. The hole 42H reduces the amount of plastic in the plastic sleeve 140 compared to a base 42 without a hole, such as the configuration of the plastic sleeve 40 shown in FIGS. 2C, 3A and 5A-5C, thereby reducing the weight of the plastic sleeve 140 compared to the configuration of the plastic sleeve 40 shown in FIGS. 2C, 3A and 5A-5C. The base 42 may be stitched, riveted, stapled, adhered or joined in any other suitable way to the foam base 14 along the line of attachment 16. The line of attachment 16 is positioned inwardly of a periphery of the base 42. Placing the line of attachment 16 along the base 42 allows for the line of attachment 16 to be concealed when the foam insert 130A,130B is inserted into the plastic sleeve 140 over the base 42.

The foam inserts 30,130 may thus be fixedly attached to the protective sport padding 10,110 via the binding 18,118. In such a configuration, it is possible to remove the foam inserts 30,130 from the protective sport padding 10,110, such as for repair or replacement, only by removing or undoing the binding 18,118 itself. It may therefore be possible to repair or replace a foam insert 30,130 without having to replace the entirety of the protective sport padding 10,110, or without having to replace the entirety of the component on which the foam-plastic protector 20,120 is disposed. It may also be possible to repair or replace a foam insert 30,130 without having to mechanically or chemically detach it from the plastic sleeve 40,140. This can be achieved by removing the binding 18,118 from the foam insert 30,130, displacing the foam insert 30,130 out of the plastic sleeve 40,140, replacing or repairing only the foam insert 30,130, re-assembling the foam-plastic protector 20,120 by inserting the new/repaired foam insert 30,130 into the plastic sleeve 40,140, and binding the new/repaired foam insert 30,130 to the protective sport padding 10,110.

Referring to FIGS. 2A to 4E, there is also disclosed a method of assembling the protective sport padding 10,110. The method includes removably inserting the foam insert 30,130 into the plastic sleeve 40,140 to inter-lock the foam insert 30,130 with the plastic sleeve 40,140 and form part of the protective sport padding 10,110. Part of the front surface 32 of the inserted foam insert 30,130 is covered by part of the plastic sleeve 40,140, and a remainder of the visible surface 32A of the inserted foam insert 30,130 is exposed to view.

Referring to FIGS. 6A-6D, there is also disclosed a method of assembling the protective sport padding 110. The method includes removably inserting the foam insert 130 into the plastic sleeve 140 to inter-lock the foam insert 130 with the plastic sleeve 140. The method includes fixedly attaching the foam insert 130 and the plastic sleeve 140 to the protective sport padding 110.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A protective sport padding, comprising: an upper protective portion for covering upper parts of shoulders, a sternum protector extending downwardly from the upper protective portion for covering a sternum, and a spine protector extending downwardly from the upper protective portion for covering part of a spine, one or both of the sternum protector and the spine protector comprising:

a foam insert having a front surface configured for facing away from a wearer and a rear surface configured for facing the wearer, the foam insert extending longitudinally between an upper end and a lower end, the foam insert having a thickness between the front surface and the rear surface and a width in a direction being transverse to the thickness, the width of the foam insert increasing from the upper end to an intermediate location disposed between the upper end and the lower end, the width of the foam insert decreasing from the intermediate location to the lower end, a maximum width of the foam insert being defined at the intermediate location, the foam insert having an upper portion between the upper end and the intermediate location and a lower portion between the intermediate location and the lower end;

and a plastic sleeve being harder than the foam insert, the plastic sleeve having a base, the plastic sleeve further having a cover secured to the base, the cover and the base being spaced apart to conjointly define a receiving space sized to receive therein the foam insert, the receiving space extending along a longitudinal axis from an open end of the receiving space via which the foam insert is received to a closed end of the receiving space located further away from the upper protective portion than the open end, the receiving space decreasing in width from the open end to the closed end, the cover overlapping solely the lower portion of the foam insert, the intermediate location of the foam insert being in register with the open end of the plastic sleeve and the upper portion of the foam insert extending outside the open end of the receiving space, the foam insert being removably insertable into the receiving space via the open end of the receiving space along a direction of insertion that is transverse to the width and extending from the open end of the receiving space toward the closed end of the receiving space, the foam insert slidable against the base in the direction of insertion transverse to the width.

2. The protective sport padding of claim 1, wherein one or both of the sternum protector and the spine protector comprise a foam base, the base of the plastic sleeve being fastened to the foam base.

3. The protective sport padding of claim 1, wherein upon being removably received against the base, the foam insert is inter-locked with the plastic sleeve to prevent displacement relative thereto in all directions except opposite to the direction of insertion.

4. The protective sport padding of claim 1, comprising a binding extending along an edge of the foam insert and affixing the foam insert to one or both of the sternum protector and the spine protector, the foam insert removable from the receiving space only by removing or undoing the binding, the foam insert free from permanent fixation to the plastic sleeve.

5. The protective sport padding of claim 1, wherein the foam insert is removably received against the base by sliding the foam insert along the base.

6. The protective sport padding of claim 1, wherein some or all of the rear surface of the foam insert abuts against the base of the plastic sleeve.

7. The protective sport padding of claim 1, wherein the cover defines a first overlapping portion and a second overlapping portion, the first and second overlapping portions disposed on opposite lateral sides of the plastic sleeve.

8. The protective sport padding of claim 7, wherein the first and second overlapping portions are disposed on the opposite lateral sides of the plastic sleeve symmetrically about a longitudinal center axis of the plastic sleeve.

9. The protective sport padding of claim 1, wherein the foam insert has a covered portion covered by the cover, the covered portion includes a first covered portion and a second covered portion, the foam insert having a central portion being exposed between the first and second covered portions.

10. The protective sport padding of claim 1, wherein the foam insert and the plastic sleeve, when inter-locked together, are free of a mechanical fastener and an adhesive.

11. The protective sport padding of claim 1, wherein the base is secured to the sternum protector or the spine protector along a line of attachment, the foam insert overlapping the line of attachment.

12. The protective sport padding of claim 9, wherein the base defines a cut-out, the overlapping portion overlapping the cut-out of the base, the foam insert free from contact with the base at the cut-out.

* * * * *